US008813734B2

(12) United States Patent
Kadoshima et al.

(10) Patent No.: US 8,813,734 B2
(45) Date of Patent: Aug. 26, 2014

(54) HEAT-INSULATING STRUCTURE

(75) Inventors: Shinji Kadoshima, Hiroshima (JP); Nobuo Sakate, Hiroshima (JP); Yoshio Tanita, Hiroshima (JP); Nobuyuki Oda, Hiroshima (JP); Yoshihisa Miwa, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 346 days.

(21) Appl. No.: 13/212,886

(22) Filed: Aug. 18, 2011

(65) Prior Publication Data

US 2012/0082841 A1 Apr. 5, 2012

(30) Foreign Application Priority Data

Sep. 30, 2010 (JP) ..... 2010-220097

(51) Int. Cl.

| | |
|---|---|
| ***F02B 75/08*** | (2006.01) |
| ***B21K 1/18*** | (2006.01) |
| ***F02B 77/11*** | (2006.01) |
| ***F02F 3/14*** | (2006.01) |

(52) U.S. Cl.

CPC ..... *F02B 77/11* (2013.01); *F05C 2251/048* (2013.01); *F02F 3/14* (2013.01)

USPC ..... 123/668; 123/193.1; 29/888.045; 29/888.061; 164/97; 419/10; 428/632

(58) Field of Classification Search

USPC ..... 123/195 R, 193.1, 668; 29/888.045, 29/888.061; 164/97; 419/10; 428/632

See application file for complete search history.

(56) References Cited

U.S. PATENT DOCUMENTS

| | | | | |
|---|---|---|---|---|
| 4,773,368 | A * | 9/1988 | Pfefferle | 123/272 |
| 5,223,213 | A * | 6/1993 | Kamimura et al. | 428/552 |
| 5,722,379 | A | 3/1998 | Binder et al. | |
| 6,071,628 | A * | 6/2000 | Seals et al. | 428/610 |
| 2004/0137259 | A1 * | 7/2004 | Pabla et al. | 428/650 |
| 2007/0163250 | A1 * | 7/2007 | Sane et al. | 60/323 |
| 2009/0260594 | A1 | 10/2009 | Hara et al. | |

FOREIGN PATENT DOCUMENTS

| | | | |
|---|---|---|---|
| EP | 352246 | A * | 1/1990 |
| EP | 2 175 116 | A1 | 4/2010 |
| EP | 2175116 | A1 | 4/2010 |
| GB | 2 086 470 | A | 5/1982 |
| GB | 2 307 193 | A | 5/1997 |
| JP | 60-184950 | A | 9/1985 |
| JP | S60-182340 | A | 9/1985 |
| JP | 62-45964 | A | 2/1987 |
| JP | 05-058760 | A | 3/1993 |
| JP | 9-277019 | A | 10/1997 |
| JP | 09277019 | A * | 10/1997 |

(Continued)

OTHER PUBLICATIONS

The extended European Search Report dated Dec. 5, 2011; Application No. 11177046.7-2311.

*Primary Examiner* — Noah Kamen

(74) *Attorney, Agent, or Firm* — Studebaker & Brackett PC

(57) ABSTRACT

Disclosed is a heat-insulating structure which can be used, for example, to reduce the cooling loss of an engine. The heat-insulating structure includes a hollow particle layer made of a lot of hollow particles densely packed on a surface of a metallic base material. The hollow particle layer is covered with a coating.

10 Claims, 5 Drawing Sheets

(56) References Cited

FOREIGN PATENT DOCUMENTS

| | | | |
|---|---|---|---|
| JP | 2003-003247 | A | 1/2003 |
| JP | 2005-146925 | A | 6/2005 |
| JP | 2009-243352 | A | 10/2009 |
| JP | 2009-257187 | A | 11/2009 |
| JP | 2010-70792 | A | 4/2010 |
| JP | 2010-185290 | A | 8/2010 |
| JP | 2010-185291 | A | 8/2010 |

* cited by examiner

HEAT-INSULATING STRUCTURE

CROSS-REFERENCE TO RELATED APPLICATION

This application claims priority under 35 U.S.C. §119 to Japanese Patent Application No. 2010-220097 filed on Sep. 30, 2010, the disclosure of which including the specification, the drawings, and the claims is hereby incorporated by reference in its entirety.

BACKGROUND

The present invention relates to heat-insulating structures used for engines, etc.

Metallic products, such as engine parts, which are exposed to high temperature gas are provided with a heat-insulating layer on a surface of the metallic base material thereof to reduce heat transfer from the high temperature gas to the base material. For example, Japanese Patent Publication No. 2009-243352 discloses that a heat-insulating film containing hollow ceramic beads is provided on a surface of an engine part facing a combustion chamber. Japanese Patent Publication No. H05-58760 discloses that surfaces of hollow siliceous spheres are coated with fine alumina particles; that the coated spheres are press-molded; and that the resulting molded body is sintered to obtain a heat-insulating material. Japanese Patent Publication No. 2005-146925 discloses that protrusions and grooves are formed in a surface of an engine cylinder head facing a combustion chamber, and that the grooves are filled with a zirconia-based, low-heat-conductivity material to increase heat resistance of the cylinder head.

To increase fuel economy of a vehicle, attempts are being made to reduce the weight of the vehicle body, improve the thermal efficiency of the engine, reduce mechanical resistance, reduce electrical load, and collect and use exhaust energy, etc. Here, it is known that in theory, the thermal efficiency of the engine increases as a geometric compression ratio is increased, or as an excess air ratio of an operative gas is increased (i.e., as a specific heat ratio is increased). However, in reality, the cooling loss (i.e., energy dissipated to the outside as heat) increases as the compression ratio is increased, or the excess air ratio is increased. Therefore, there is a limitation in improving the thermal efficiency by increasing the compression ratio or the excess air ratio.

Specifically, the cooling loss depends on a coefficient of heat transfer from the operative gas to the engine combustion chamber wall, a heating surface area of the wall, and a difference between a gas temperature and a wall temperature. The heat-transfer coefficient is a function of a gas pressure and a gas temperature. Thus, if the gas pressure and the gas temperature are increased due to an increase in compression ratio and excess air ratio, it leads to an increase in heat-transfer coefficient and results in greater cooling loss. A difference between the wall temperature and the gas temperature is increased as well, which also results in greater cooling loss. Thus, although setting the compression ratio to a very high compression ratio (e.g., 20 or more) results in a higher expansion ratio, and is effective in reducing exhaust loss, it is difficult to set the compression ratio to a very high compression ratio for reasons of greater cooling loss as described above.

Alternatively, the efficiency of the engine may be increased (or fuel economy may be improved) by collecting exhaust energy without significantly increasing the compression ratio. However, in this case too, the greater the cooling loss is, the smaller the exhaust energy becomes. Therefore, similarly to the case of increasing the compression ratio, it is important to reduce the cooling loss.

SUMMARY

In view of this, the present invention provides a heat-insulating structure which can be used, for example, to reduce the cooling loss of an engine as described above.

The present invention is a heat-insulating structure using hollow particles. Specifically, the heat-insulating structure described herein includes a hollow particle layer made of a lot of hollow particles densely packed on a surface of a metallic base material (in other words, made of a lot of hollow particles covering the surface of the metallic base material), and the hollow particle layer is covered with a coating.

According to this heat-insulating structure, air thermal insulation is high due to the hollow particle layer made of a lot of hollow particles densely packed. Also, since heat capacity per unit volume (i.e., volumetric specific heat) is lowered due to air, the temperature of a surface of the heat-insulating structure responsively increases or decreases in accordance with an increase or decrease of the gas temperature in a combustion chamber, in the case of an engine. Thus, the cooling loss is reduced. Further, the coating covering the hollow particle layer prevents the hollow particles from being damaged by external forces, etc., and prevents the hollow particles from being detached or separated. Thus, durability is improved.

Preferably, adjacent hollow particles of the hollow particle layer are joined together. With this structure, the strength of the hollow particle layer as bulk is increased, and the durability is advantageously ensured.

Preferably, a fine solid particle is provided in a space between the hollow particles of the hollow particle layer. With this structure, the strength of the hollow particle layer as bulk is increased, and the durability is advantageously ensured.

Preferably, the hollow particle layer is brazed to the metallic base material. With this structure, the bonding strength of the hollow particle layer with the metallic base material is increased. Thus, the separation of the hollow particle layer is prevented, and the durability is advantageously ensured.

Preferably, a metal which forms the metallic base material is impregnated into a space between the hollow particles of the hollow particle layer from a metallic base material side, and is solidified, and the metallic base material and the hollow particle layer are integrally combined with each other by the portion where the metal is impregnated and solidified. With this structure, the bonding strength of the hollow particle layer with the metallic base material is increased. That is, the separation of the hollow particle layer is prevented, and the durability is advantageously ensured.

Preferably, a thermal conductivity of the coating is higher than a thermal conductivity of the hollow particle layer. Specifically, if the thickness of the hollow particle layer is not uniform throughout the layer, and is locally thick or thin, local variations of the temperature of the coating may be caused due to differences in heat insulation. For example, in the case where the coating forms a wall surface of a combustion chamber of an engine, a portion at which the temperature of the coating is locally high may cause abnormal combustion (e.g., pre-ignition). To avoid this, the thermal conductivity of the coating is increased to improve thermal diffusion along which the coating expands, and to prevent a local increase of the temperature of the coating. If the local variations of the temperature of the coating cause a problem, it is preferable to make a thermal conductivity of the coating equal to or greater than ten times a thermal conductivity of the hollow particle layer, more preferably equal to or greater than a hundred times a thermal conductivity of the hollow particle layer. To make the temperature of a surface of the heat-insulating structure responsively increase or decrease in accordance with an increase or decrease of the gas temperature in a combustion chamber, the heat capacity of the coating is preferably not greater than the heat capacity of the hollow particle layer. For this reason, the thickness of the coating is preferably equal to or less than half the thickness of the hollow particle layer.

On the other hand, to increase the heat insulation of the heat-insulating structure as much as possible, a thermal conductivity of the coating is preferably lower than a thermal conductivity of the metallic base material. Further, the volumetric specific heat of the coating is preferably lower than the volumetric specific heat of the metallic base material.

According to a preferred embodiment, the metallic base material forms an engine part, and the hollow particle layer and the coating are provided on a surface of the engine part which faces a combustion chamber of an engine, an inner wall surface of an intake port, or an inner wall surface of an exhaust port.

If a surface of an engine part which faces a combustion chamber of an engine is formed of the heat-insulating layer made of the hollow particle layer and the coating, the cooling loss of the engine is advantageously reduced.

If an inner wall surface of an intake port of a cylinder head is formed of the heat-insulating layer made of the hollow particle layer and the coating, it is possible to prevent intake air from being heated by the cylinder head before the intake air is taken in the cylinder. This means that the efficiency in charging the cylinder with the intake air is advantageously improved. In the case of an engine having a high geometric compression ratio (e.g., $\epsilon$ is about 20 to 50), it is possible to reduce the gas temperature in the cylinder before compression. As a result, abnormal combustion is advantageously prevented. Further, an abnormal increase in combustion temperature (which leads to greater cooling loss, and NOx is more likely to be generated) is advantageously prevented.

If an inner wall surface of an exhaust port of a cylinder head is formed of the heat-insulating layer made of the hollow particle layer and the coating, a combustion exhaust gas can be discharged while the temperature of the combustion exhaust gas is high. Thus, the exhaust energy is advantageously collected.

Examples of the engine part include a piston, a cylinder head, a cylinder block, a cylinder liner, an intake valve, and an exhaust valve.

DETAILED DESCRIPTION

An embodiment of the present invention will be described below based on the drawings. The following embodiment is merely a preferred example in nature, and is not intended to limit the scope, applications, and use of the invention.

Figure 1:
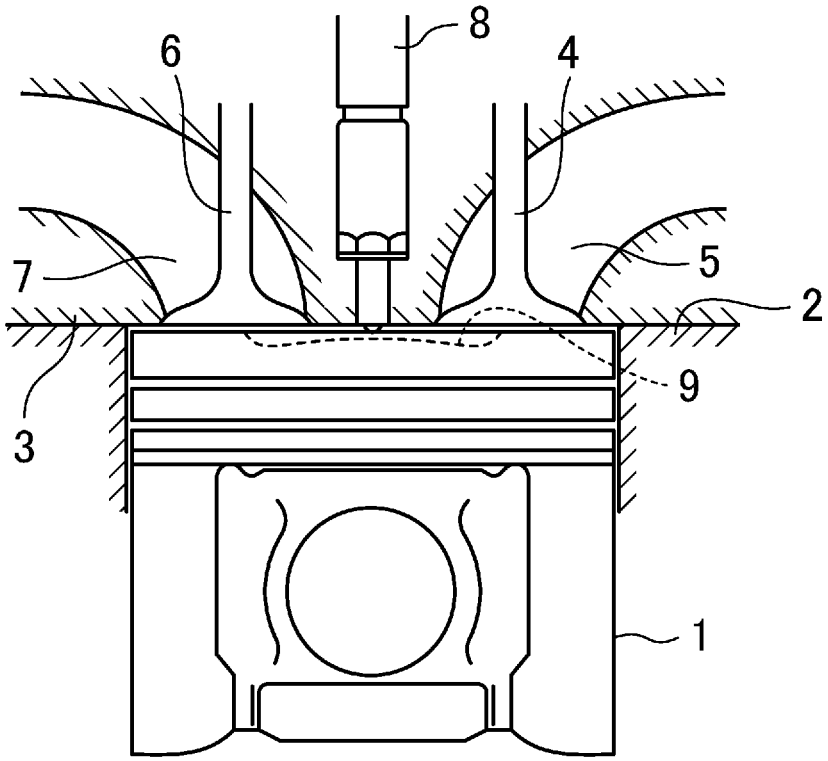
FIG. 1 is a cross-sectional view showing an engine structure according to an embodiment of the present invention.

In this embodiment, a heat-insulating structure according to the present invention is applied to the engine piston 1 shown in FIG. 1.

<Features of Engine>

In FIG. 1, the reference character 2 is a cylinder block; the reference character 3 is a cylinder head; the reference character 4 is an intake valve for opening and closing an intake port 5 of the cylinder head 3; the reference character 6 is an exhaust valve for opening and closing an exhaust port 7; and the reference character 8 is a fuel injection valve. The engine combustion chamber is formed by being surrounded by the top face of the piston 1, the cylinder block 2, the cylinder head 3, and the front faces of the umbrella portions of the intake and exhaust valves 4, 6 (i.e., faces facing toward the combustion chamber). A cavity 9 is formed in the top face of the piston 1. The spark plug is not shown.

This engine is a lean burn engine having a geometric compression ratio $\epsilon$ of 20 to 50, and driven at an excess air ratio $\lambda$ of 2.5 to 6.0 at least in a partial load area. Thus, as explained above, the cooling loss of the engine has to be significantly reduced, or in other words, the heat insulation properties of the engine has to be increased, to achieve desired thermal efficiencies corresponding to the compression ratio $\epsilon$ and the excess air ratio $\lambda$. This will be described based on an indicated thermal efficiency obtained by making a model calculation. Specifically, the model calculation was performed to check how the indicated thermal efficiency was affected depending on whether the combustion chamber had a heat-insulating structure or not, or depending on an increase and a decrease of the excess air ratio $\lambda$, when the compression ratio $\epsilon$ was increased.

Figure 2:
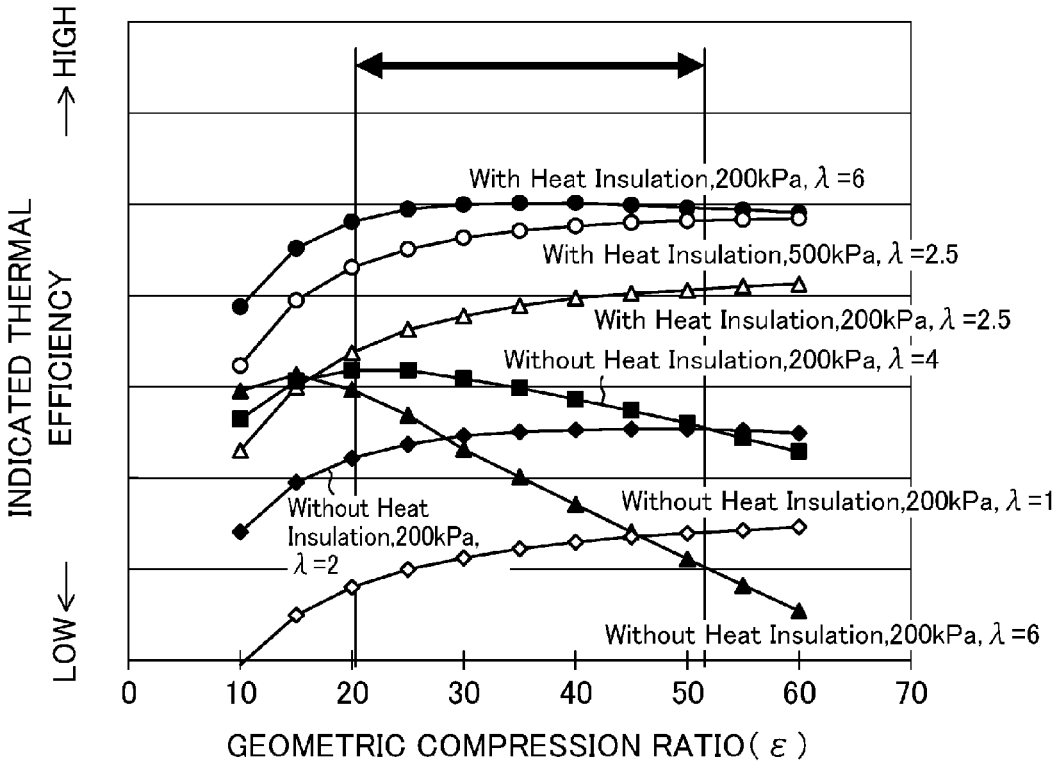
FIG. 2 is a graph showing a relationship between geometric compression ratios and indicated thermal efficiencies of engines having different specifications.

FIG. 2 shows the results. In FIG. 2, "Without Heat Insulation" is about a conventional engine in which the combustion chamber does not have a heat-insulating structure; "With Heat Insulation" is about an engine in which the heat-insulating ratio of the combustion chamber is higher than that of the conventional engine without heat insulation by 50%; and "200 kPa" and "500 kPa" indicate the magnitudes of engine loads.

First, in the case of "Without Heat Insulation, 200 kPa, $\lambda$=1," the indicated thermal efficiency increases as the compression ratio $\epsilon$ is increased. However, the indicated thermal efficiency does not much improve even after the compression ratio $\epsilon$ exceeds 50. Since the theoretical efficiency at the time of compression ratio $\epsilon$ is 50 is about 80%, the indicated thermal efficiency of this engine is very low. This difference is mostly because of the cooling loss and the exhaust loss.

In the case of "Without Heat Insulation, 200 kPa, $\lambda$=2," the indicated thermal efficiency increases because the specific heat ratio decreases due to an increase in excess air ratio. However, the indicated thermal efficiency is still lower than the theoretical efficiency. Turning to the case of "Without Heat Insulation, 200 kPa, $\lambda$=4" and the case of "Without Heat Insulation, 200 kPa, $\lambda$=6," the higher the compression ratio $\epsilon$ becomes, the lower the indicated thermal efficiency becomes, after the compression ratio $\epsilon$ exceeds 15 or 25. This is because, since the excess air ratio λ is high (i.e., since the air density of a fuel-air mixture is high), the gas pressure at the time of combustion significantly increases when the compression ratio is high, and a heat-transfer coefficient which is a function of the gas pressure and the gas temperature is increased, resulting in greater cooling loss. In other words, the cooling loss increases more than the thermal efficiency increases due to the high excess air ratio λ (i.e., the high specific heat ratio).

On the other hand, in the case of "With Heat Insulation, 200 kPa, λ=2.5," the indicated thermal efficiency increases as the compression ratio ϵ is increased. In the case of "With Heat Insulation, 200 kPa, λ=6" in which the excess air ratio λ is high, although the indicated thermal efficiency slightly decreases after the compression ratio ϵ exceeds 40, the indicated thermal efficiency is very high when the compression ratio ϵ is from 20 to 50.Also in the case of "With Heat Insulation, 500 kPa, λ=2.5" in which the engine load is high, the indicated thermal efficiency is very high when the compression ratio ϵ is from 20 to 50.

Figure 3:
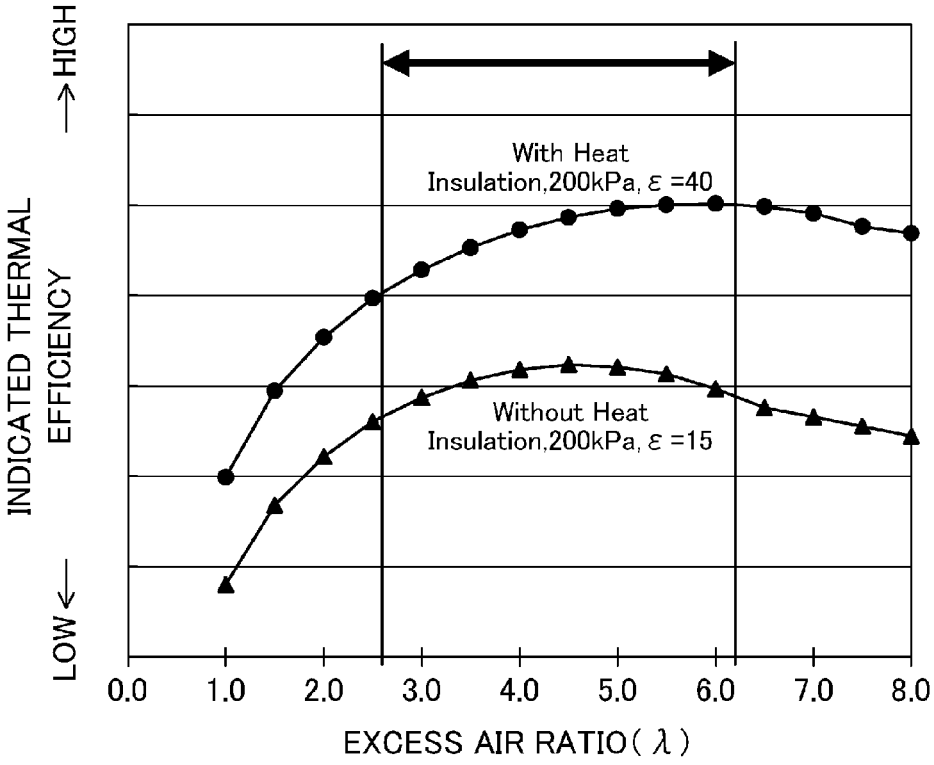
FIG. 3 is a graph showing a relationship between excess air ratios $\lambda$ and indicated thermal efficiencies of engines having different specifications.

FIG. 3 is a graph showing a relationship between the excess air ratio λ and the indicated thermal efficiency. In the case of "Without Heat Insulation, 200 kPa, ϵ=15," the indicated thermal efficiency reaches a peak when the excess air ratio λ is about 4.5, and the indicated thermal efficiency decreases after the excess air ratio λ exceeds the peak ratio. On the other hand, in the case of "With Heat Insulation, 200 kPa, ϵ=40," the indicated thermal efficiency reaches a peak when the excess air ratio λ is about 6.0. This is a result of having the high compression ratio ϵ, and reducing cooling loss by heat insulation.

The above lean burn engine is driven at an excess air ratio λ of 2.5 or higher at least in a partial load area. Thus, the generation of NOx is advantageously reduced. If the compression ratio ϵ increases, a combustion temperature increases. However, the generation of NOx can be reduced by preventing a maximum combustion temperature from exceeding 1800 K by controlling the excess air ratio λ such that the excess air ratio λ increases as the engine load is increased.

Although not shown in the drawings, an inter cooler for cooling intake air is provided in the intake system of the above engine. Thus, a gas temperature in the cylinder at the beginning of compression is lowered, and an increase in gas pressure and an increase in gas temperature at the time of combustion are prevented. Thus, the cooling loss can be advantageously reduced (i.e., the indicated thermal efficiency can be improved).

<Heat-Insulating Structure>

Now, a heat-insulating structure for reducing the cooling loss which is necessary to increase the indicated thermal efficiency of the engine driven at a very high compression ratio ϵ of 20 to 50 and at a high excess air ratio λ of 2.5 to 6.0, will be described below.

Figure 4:
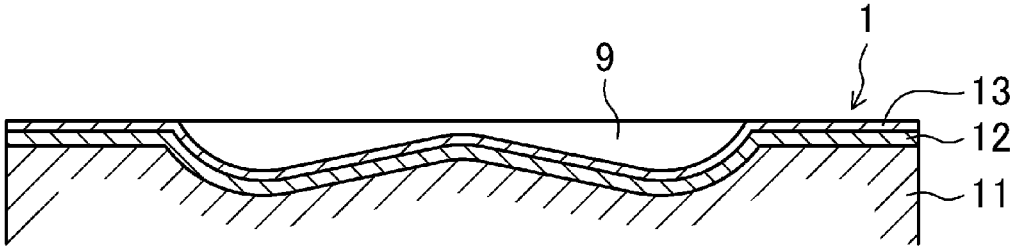
FIG. 4 is a cross-sectional view showing a heat-insulating structure of an aluminum alloy piston according to an embodiment of the present invention.
Figure 5:
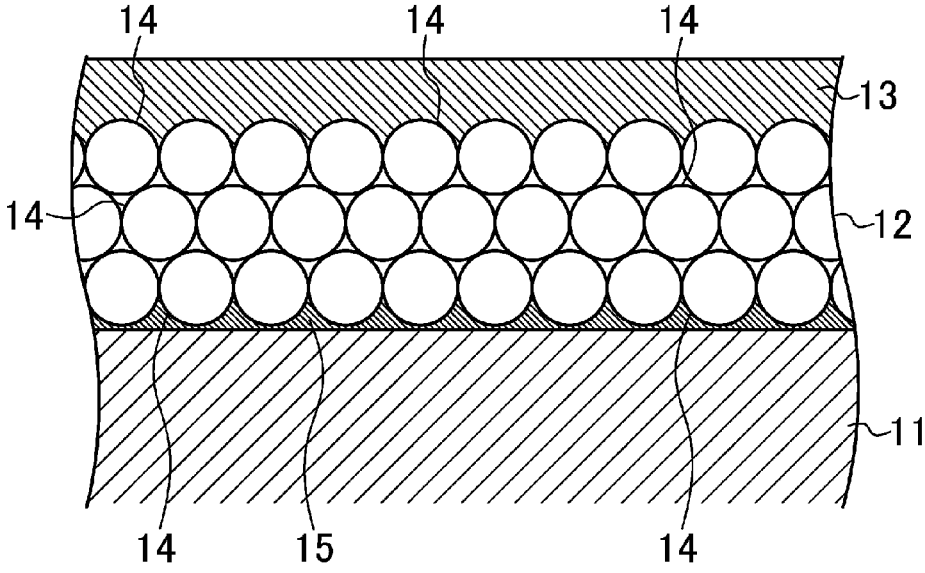
FIG. 5 is an enlarged cross-sectional view of a heat-insulating layer of the piston.
Figure 6:
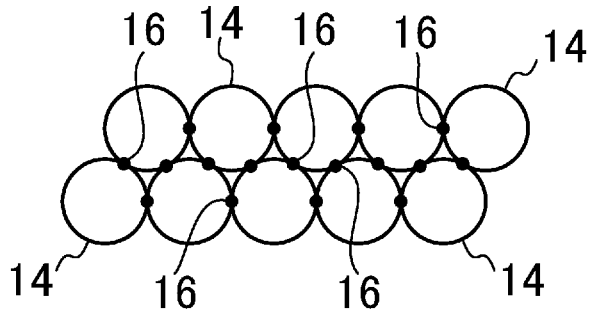
FIG. 6 is a cross-sectional view of part of a hollow particle compact used for a hollow particle layer of the heat-insulating layer.

FIG. 4 shows a heat-insulating structure of the piston 1. Specifically, the piston 1 has a heat-insulating layer on the top face which forms the combustion chamber of the engine. The heat-insulating layer includes a hollow particle layer 12 formed on the entire top face of the piston base material 11, and a coating 13 which covers the hollow particle layer 12. As shown in FIG. 5, the hollow particle layer 12 is made of a lot of hollow particles 14 densely packed on the top face of the piston base material 11 (i.e., made of a lot of hollow particles 14 covering the top face of the piston base material 11 in one or more layers), and is joined (or brazed) to the piston base material 11 with a brazing filler metal 15. Further, as shown in FIG. 6, adjacent hollow particles 14 are joined together at a contact point 16.

The piston base material 11 may be formed, for example, of a cast aluminum alloy (Japanese Industrial Standards (JIS) AC8A, thermal conductivity of 141.7 W/(m·K), volumetric specific heat of 2300 kJ/($m^3$·K)), or may be formed of another aluminum alloy. Alternatively, the piston base material 11 may be a cast-iron piston.

Examples of the hollow particles 14 includes ceramic hollow particles, such as alumina bubbles, fly ash balloons, shirasu balloons, silica balloons, and aerogel balloons, and other inorganic hollow particles. Materials and particle diameters of the example hollow particles are shown in Table 1.

TABLE 1

| Type of Hollow Particle | Material | Particle Diameter (μm) |
|---|---|---|
| Alumina Bubble | $Al_2O_3$ | 100-8000 |
| Fly Ash Balloon | $SiO_2$, $Al_2O_3$ | 1-300 |
| Shirasu Balloon | $SiO_2$, $Al_2O_3$ | 5-600 |
| Silica Balloon | $SiO_2$, $Al_2O_3$ | 0.09-0.11 |
| Aerogel Balloon | $SiO_2$ | 0.02-0.05 |

For example, the chemical compositions of the fly ash are $SiO_2$ (40.1-74.4% by mass), $Al_2O_3$ (15.7-35.2% by mass), $Fe_2O_3$ (1.4-17.5% by mass), MgO (0.2-7.4% by mass), and CaO (0.3-10.1% by mass). The chemical compositions of the shirasu balloons are $SiO_2$ (75-77% by mass), $Al_2O_3$ (12-14% by mass), $Fe_2O_3$ (1-2% by mass), $Na_2O$ (3-4% by mass), $K_2O$ (2-4% by mass), and IgLoss (2-5% by mass).

In the case of the above example hollow particles, the thermal conductivity of the hollow particle layer 12 is about 0.03 to 0.3 W/(m·K), and the volumetric specific heat of the hollow particle layer 12 is about 200 to 1900 kJ/($m^3$·K).

To make the coating 13 have a thermal conductivity higher than the thermal conductivity of the hollow particle layer 12, a metal such as an aluminum alloy, Ni, an Ni—Cr alloy may be used as a coating material. The thermal conductivity of the cast aluminum alloy JIS AC8A is 141.7 W/(m·K); the thermal conductivity of the Ni-20Cr alloy is 12.6 W/(m·K); and the thermal conductivity of Ni is 97 W/(m·K). The volumetric specific heat of the cast aluminum alloy AC8A is 2300 kJ/($m^3$·K); the volumetric specific heat of the Ni-20Cr alloy is 3660 kJ/($m^3$·K); and the volumetric specific heat of Ni is 3980 kJ/($m^3$·K).

To make the coating 13 have a thermal conductivity lower than the thermal conductivity of the piston base material 1 in order to increase heat insulation, a metallic oxide such as $ZrO_2$ may be used as a coating material. For example, if $Y_2O_3$-stabilized $ZrO_2$ (YSZ) is used as a coating material, the thermal conductivity of the coating 13 is 1.44 W/(m·K), and the volumetric specific heat of the coating 13 is 2760 kJ/($m^3$·K). In this case, the coating 13 can have a porous structure by being plasma sprayed. For example, the thermal conductivity becomes 0.87 W/(m·K) when the porosity is 10%, and the thermal conductivity becomes 0.77 W/(m·K) when the porosity is 25%.

The thickness of the hollow particle layer 12 may be, for example, about 10 to 1000 μm. The thickness of the coating 13 may be, for example, about 1 to 500 μm.

The adjacent hollow particles 14 may be joined together at the contact point by pulse electric current sintering (or spark plasma sintering). According to this technique, pulsed voltage and current are applied simultaneously with the application of pressure. This can cause a local heating at the contact point between the hollow particles 14 by discharge. Thus, the adjacent hollow particles 14 can be joined together without damage.

The main components of the above example hollow particles 14 is $Al_2O_3$ and/or $SiO_2$. Thus, the pulse electric current sintering may be performed under the conditions of a pressure of 1 to 300 MPa, a temperature of 700 to 1700° C., time of 1 to 60 minutes, a current of 50 to 10000 A, a voltage of 4 to 20 V, and a frequency of 5 to 30000 Hz. For example, in the case of alumina bubbles (having a particle diameter of 100 to 500 μm), the conditions may be a pressure of 30 to 100 MPa, a current of 50 to 4000 A, a voltage of 4 to 10 V, a frequency of 10 to 10000 Hz, a temperature of 900 to 1200° C., and time of 1 to 20 minutes. In the case of fly ash balloons, the conditions may be a pressure of 50 MPa, a current of 80 to 150 A, a voltage of 5 V, a frequency of 10 Hz, a temperature of 700 to 1100° C., and time of 20 minutes or less.

The piston 1 having the above heat-insulating structure can be obtained by the following method. That is, a brazing filler metal is placed on the top face of the piston base material 11, and a sheet-like hollow particle compact obtained by the pulse electric current sintering is placed on the brazing filler metal. Then, the brazing filler metal is melted by heating, and is pressurized and cooled to fix the hollow particle compact on the top face of the piston base material 11 as the hollow particle layer 12. As the brazing filler metal, AM-350 (aluminum-use solder (Zn-5Al), a brazing temperature of 350 to 400° C.) produced by Nihon Almit Co., Ltd. may be used, for example. Next, a coating material is plasma sprayed (if Ni is used as a coating material, the coating material may be electroless plated) on a surface of the hollow particle layer 12 to form the coating 13.

According to this heat-insulating structure of the piston, the hollow particle layer 12 is made of a lot of hollow particles 14 which are densely packed. Thus, a significant air thermal insulation effect can be obtained. Of the energy generated by the fuel combustion, the amount of energy dissipated to the outside as heat through the piston 1 is reduced (i.e., the cooling loss is reduced).

In the hollow particle layer 12, adjacent hollow particles 14 are joined together. Therefore, the strength of the hollow particle layer 12 as bulk is high. The coating 13 prevents the impregnation of the fuel in the hollow particle layer 12 or the entry of carbon, and also prevents damage to the hollow particles 14 by external forces etc., or detachment or separation of the hollow particles 14. As shown in FIG. 5, fine projections and depressions are formed in a surface of the hollow particle layer 12 (i.e., a depression is formed between adjacent hollow particles 14 in a surface layer portion). Therefore, a coating material enters the depression, and increases adhesion between the hollow particle layer 12 and the coating 13. Further, since the hollow particle layer 12 is brazed to the piston base material 11, separation of the hollow particle layer 12 is avoided.

If an aluminum alloy, Ni, an Ni—Cr alloy, etc., is used as a coating material to make the coating 13 have a thermal conductivity higher than the thermal conductivity of the hollow particle layer 12, the thermal diffusion in a direction along which the coating 13 expands is improved. Thus, it is possible to prevent formation of an area on the top face of the piston at which a temperature is locally increased (an area to be an ignition source of abnormal combustion).

If a material such as plasma-sprayed $Y_2O_3$-stabilized $ZrO_2$ of which the thermal conductivity is low and the volumetric specific heat is also low is used as a coating material, heat insulation is beneficially ensured. Particularly if the volumetric specific heat of the coating 13 is low, a surface temperature of the top portion of the piston 1 promptly increases as a temperature of the combustion chamber increases due to fuel combustion. Therefore, a difference between a gas temperature in the combustion chamber and the surface temperature of the top portion of the piston is not increased, and the cooling loss is reduced.

In the above embodiment, the hollow particles 14 are sintered to obtain a hollow particle compact. Alternatively, a thin binder film may be provided to a surface of each of the hollow particles 14, and the hollow particles 14 may be hot pressed to obtain a hollow particle compact in which the hollow particles 14 are joined together by a binder. In this case, a silicon based material or a graphite based material is preferably used as the binder to ensure a heat resistance.

Figure 7:
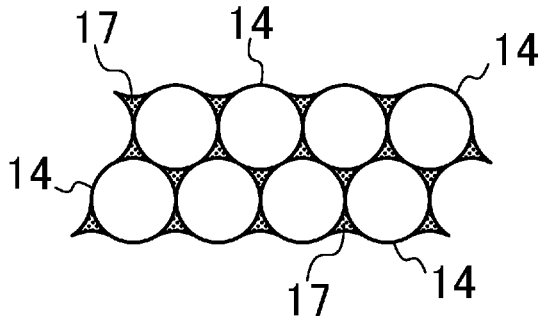
FIG. 7 is a cross-sectional view of part of a hollow particle compact according to another embodiment.

In the hollow particle layer 12 of the above embodiment, the hollow particles 14 are joined together. Alternatively, as shown in FIG. 7, fine solid particles 17 may be provided in a space between tightly packed hollow particles 14. As a result, the strength of the hollow particle layer 12 as bulk is increased, and the durability is advantageously ensured. In this case, it is more preferable to provide the fine solid particles 17 in a space between the hollow particles 14 joined together as in the above embodiment.

As the fine solid particles 17, a metallic oxide, such as zirconia, silica, alumina, and silicon nitride, whose thermal conductivity is lower than the thermal conductivity of the piston base material 11, or a non-oxide ceramics particle is preferably used. For example, sol of fine solid particles is prepared; the sol is impregnated into the hollow particle layer 12; and thereafter moisture is evaporated to provide the fine solid particles in a space between the hollow particles 14.

Figure 8:
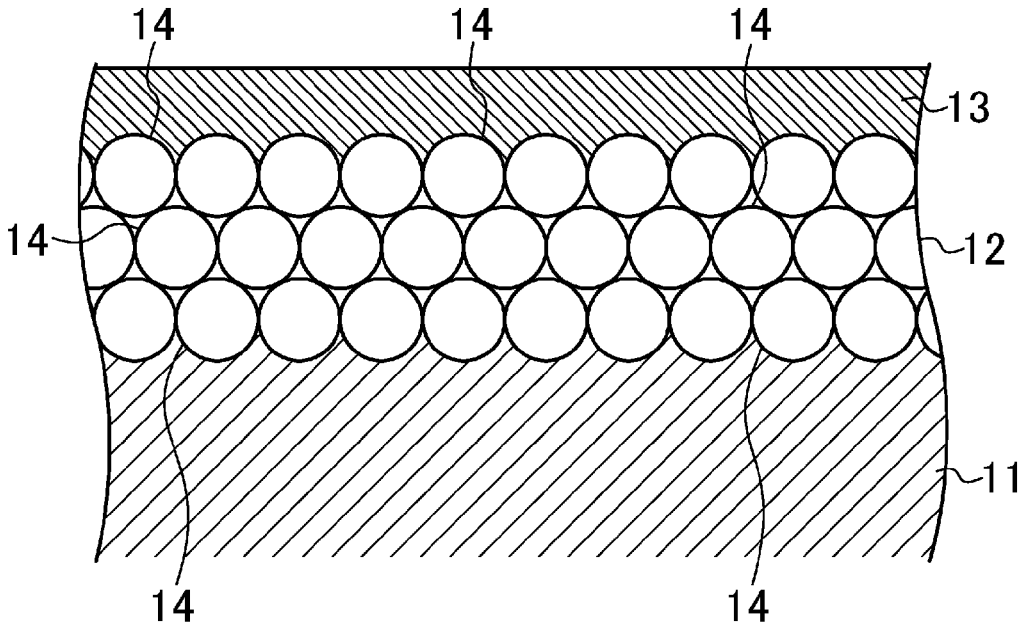
FIG. 8 is an enlarged cross-sectional view of a heat-insulating layer of a piston according to another embodiment.

In the above embodiment, the hollow particle compact is brazed to the piston base material 11. Alternatively, the hollow particle compact may be integrally combined with the piston base material 11 by cast-in bonding process. Specifically, an aluminum alloy molten metal is pressure injected into piston molds, with a hollow particle compact present in the piston molds. The aluminum alloy molten metal is impregnated into a space between hollow particles of the hollow particle compact, and is solidified. As a result, as shown in FIG. 8, the piston base material 11 and the hollow particle layer 12 are integrally combined with each other by the portion where the aluminum alloy impregnated into a space between the hollow particles is solidified. According to this combined structure, the bonding strength of the hollow particle layer 12 with the piston base material 11 is increased. As a result, the separation of the hollow particle layer 12 can be prevented, and the durability of the hollow particle layer 12 can be advantageously ensured.

What is claimed is:

1. A heat-insulating structure, comprising:

a hollow particle layer made of a plurality of hollow particles densely packed on a surface of a metallic base material, wherein the plurality of hollow particles include at least one of an $Al_2O_3$ component or an $SiO_2$ component, and a portion of the surfaces of the hollow particles that are in contact with surfaces of adjacent hollow particles are not coated with a metallic particle, and the adjacent hollow particles in the hollow particle layer are directly joined together without a metal layer intervening therebetween, at a contact point where the adjacent hollow particles are in contact with each other, and a surface of the hollow particle layer is covered with a coating.

2. The heat-insulating structure of claim 1, wherein a fine solid particle is provided in a space between the hollow particles of the hollow particle layer.

3. The heat-insulating structure of claim 1, wherein the hollow particle layer is brazed to the metallic base material.

4. The heat-insulating structure of claim 1, wherein a metal which forms the metallic base material is impregnated into a space between the hollow particles of the hollow particle layer from a metallic base material side, and is solidified, and the metallic base material and the hollow particle layer are integrally combined with each other by the portion where the metal is impregnated and solidified.

5. The heat-insulating structure of claim 1, wherein a thermal conductivity of the coating is higher than a thermal conductivity of the hollow particle layer.

6. The heat-insulating structure of claim 5, wherein the coating is made of one of an aluminum alloy, Ni, or an Ni—Cr alloy.

7. The heat-insulating structure of claim 1, wherein a thermal conductivity of the coating is lower than a thermal conductivity of the metallic base material.

8. The heat-insulating structure of claim 1, wherein the metallic base material forms an engine part, and the hollow particle layer and the coating are provided on a surface of the engine part which faces a combustion chamber of an engine, an inner wall surface of an intake port, or an inner wall surface of an exhaust port.

9. The heat-insulating structure of claim 8, wherein the engine is a lean burn engine having a geometric compression ratio $\epsilon$ of 20 to 50, and driven at an excess air ratio $\lambda$ of 2.5 to 6.0 at least in a partial load area.

10. A heat-insulating structure, comprising:

a hollow particle layer made of a plurality of hollow particles densely packed on a surface of a metallic base material, wherein the plurality of hollow particles include at least one of an $Al_2O_3$ component or an $SiO_2$ component, and surfaces of each hollow particle that are in contact with surfaces of an adjacent hollow particle are not coated with a metallic particle, and adjacent hollow particles in the hollow particle layer are directly joined together without a metal layer intervening therebetween, at a contact point where the adjacent hollow particles are in contact with each other, and a surface of the hollow particle layer is covered with a coating.

* * * * *